US009484685B2

(12) United States Patent
Zhou et al.

(10) Patent No.: US 9,484,685 B2
(45) Date of Patent: Nov. 1, 2016

(54) CABLE CONNECTOR ASSEMBLY WITH OPTICAL ELEMENT TRANSMITTING LED LIGHT

(71) Applicant: FOXCONN INTERCONNECT TECHNOLOGY LIMITED, Grand Cayman (KY)

(72) Inventors: Zhi-Yong Zhou, Kunshan (CN); Xiao Fan, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/968,823

(22) Filed: Dec. 14, 2015

(65) Prior Publication Data

US 2016/0172795 A1 Jun. 16, 2016

(30) Foreign Application Priority Data

Dec. 12, 2014 (CN) ..... 2014 2 0781056 U

(51) Int. Cl.

| | |
|---|---|
| ***H01R 13/648*** | (2006.01) |
| ***H01R 13/717*** | (2006.01) |
| ***F21V 7/05*** | (2006.01) |
| *F21W 111/00* | (2006.01) |
| *F21Y 101/02* | (2006.01) |

(52) U.S. Cl.

CPC ..... *H01R 13/7175* (2013.01); *F21V 7/05* (2013.01); *F21W 2111/00* (2013.01); *F21Y 2101/02* (2013.01)

(58) Field of Classification Search

CPC ..... H01R 23/65802; H01R 13/2442

USPC ..... 439/607.01, 701, 260, 626

See application file for complete search history.

(56) References Cited

U.S. PATENT DOCUMENTS

| | | | | |
|---|---|---|---|---|
| 7,534,140 | B2 * | 5/2009 | Zheng | H01R 23/6873 439/607.01 |
| 7,682,199 | B2 * | 3/2010 | Ahn | H01R 24/62 439/660 |
| 7,824,219 | B2 * | 11/2010 | Wang | H01R 13/65802 439/607.27 |
| 7,914,299 | B2 * | 3/2011 | Lee | G06K 19/07732 439/76.1 |
| 8,262,414 | B1 * | 9/2012 | Li | H01R 13/6273 439/607.35 |
| 8,292,662 | B2 * | 10/2012 | Yang | H01R 13/5202 439/271 |
| 9,112,296 | B2 * | 8/2015 | Zhang | H01R 13/516 |

FOREIGN PATENT DOCUMENTS

CN 102761035 A 10/2012

* cited by examiner

*Primary Examiner* — Phuongchi T Nguyen

(74) *Attorney, Agent, or Firm* — Wei Te Chung; Ming Chieh Chang

(57) ABSTRACT

A cable connector assembly includes an electrical connector and a cable electrically connected with the electrical connector. The electrical connector defines a plug portion, a printed circuit board electrically connected to the plug portion, a pair of LED lamps mounted on the printed circuit board, an optical element transmitting the light emitted by the LED lamps and an insulative housing covering the printed circuit board. The optical element defines a pair of transition portions transmitting the light emitted by the LED lamps and a photic zone, the photic zone of the optical element is exposed to the insulative shell and has a closed circumference so that the light emitted by the LED lamps passes through the photic zone to form a continuous aperture.

18 Claims, 9 Drawing Sheets

CABLE CONNECTOR ASSEMBLY WITH OPTICAL ELEMENT TRANSMITTING LED LIGHT

BACKGROUND OF THE INVENTION

1. Field of the Invention

The present invention relates to a cable connector assembly, and more particularly to a cable connector assembly with an optical element transmitting LED's light.

2. Description of the Related Art

Chinese Patent No. 102761035A issued on Oct. 31, 2012, discloses a cable connector assembly including a printed circuit board, a LED lamp disposed on the printed circuit board, a light pipe disposed above the LED lamp and a shielding shell covering the printed circuit board. The light pipe defines a protrusion, the light emitted by the LED lamp is extending to the shielding shell via the protrusion of the light pipe so that the user can determine the working status of the connector by observing the LED's light situation. However, the LED's light forms a photic zone disposed on the protrusion of the light pipe, the area of the photic zone is smaller, which is not conducive to user observation.

Therefore, an improved cable connector assembly is highly desired to meet overcome the requirement.

BRIEF SUMMARY OF THE INVENTION

An object of the present invention is to provide a cable connector assembly with an optical element transmitting LED light which is easy to observe the working status.

In order to achieve above-mentioned object, a cable connector assembly includes an electrical connector and a cable electrically connected with the electrical connector. The electrical connector defines a plug portion, a printed circuit board electrically connected to the plug portion, a pair of LED lamps mounted on the printed circuit board, an optical element transmitting the light emitted by the LED lamps and an insulative housing covering the printed circuit board. The optical element defines a pair of transition portions transmitting the light emitted by the LED lamps and a photic zone, the photic zone of the optical element is exposed to the insulative shell and has a closed circumference so that the light emitted by the LED lamps passes through the photic zone to form a continuous aperture.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
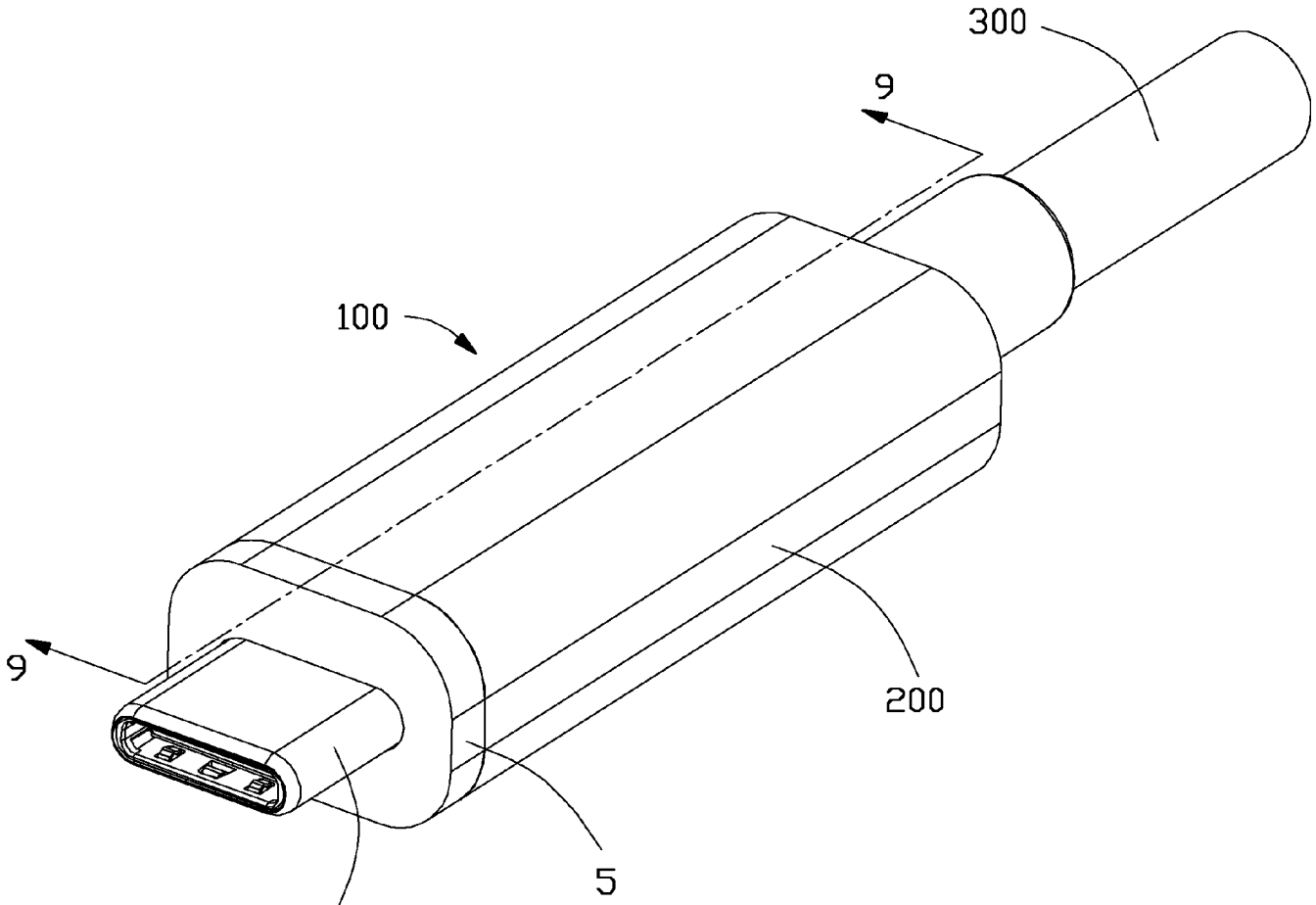
FIG. 1 is a perspective view showing a cable connector assembly in accordance with the present invention.
Figure 2:
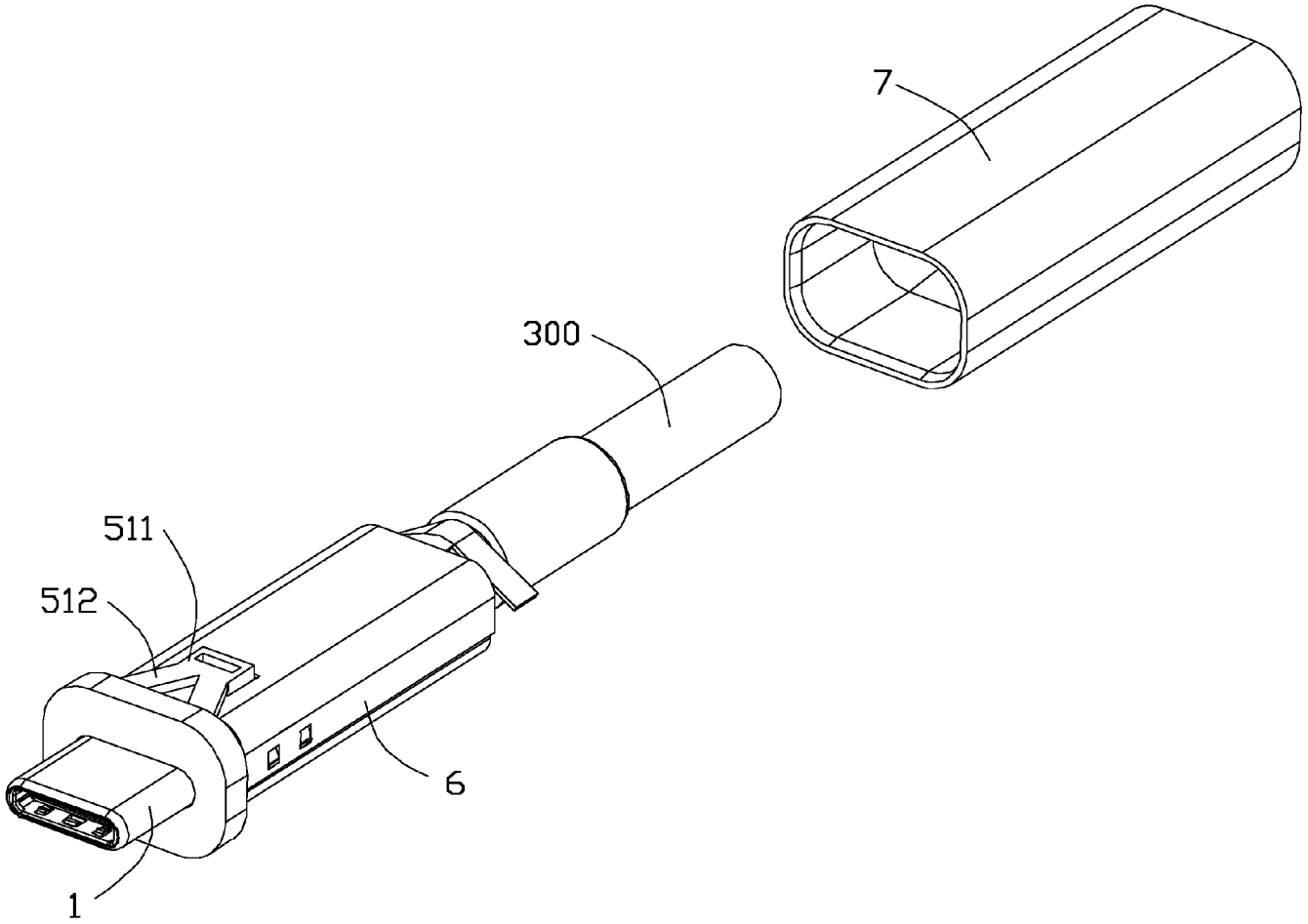
FIG. 2 is a partially exploded view of the cable connector assembly shown as in FIG. 1.
Figure 6:
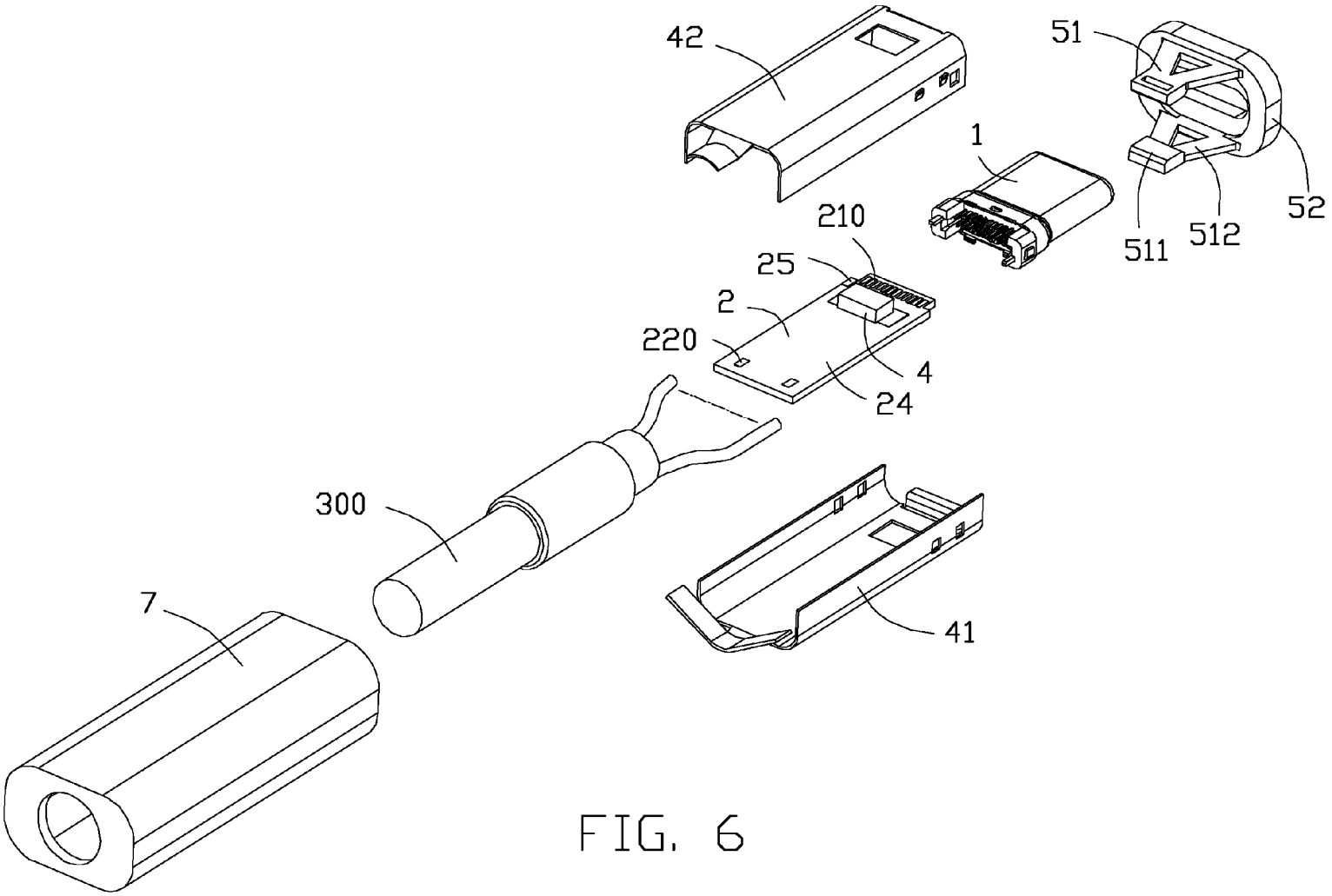
FIG. 6 is a perspective view of the cable connector assembly as shown in FIG. 5 but from a different perspective.

Reference will now be made to the drawing figures to describe a preferred embodiment of the present invention in detail. Referring to FIG. 1 and FIG. 6, a cable connector assembly 100 in accordance with the present invention for mating with a mating connector (not shown) includes an electrical connector 200 and a cable 300 electrically connected with the electrical connector 200. The electrical connector 200 includes a plug portion 1, a printed circuit board (PCB) 2 electrically connected to the plug portion 1, a pair of LED lamps 4 mounted on the printed circuit board 2, an optical element 5 transmitting the LED's light, a metal shell 6 covering part of the cable 300 and the plug portion 1, and an insulative housing or cover 7 covering the printed circuit board. The cable connector assembly 100 can be mated with the mating connector in two different directions to achieve the same function.

Figure 7:
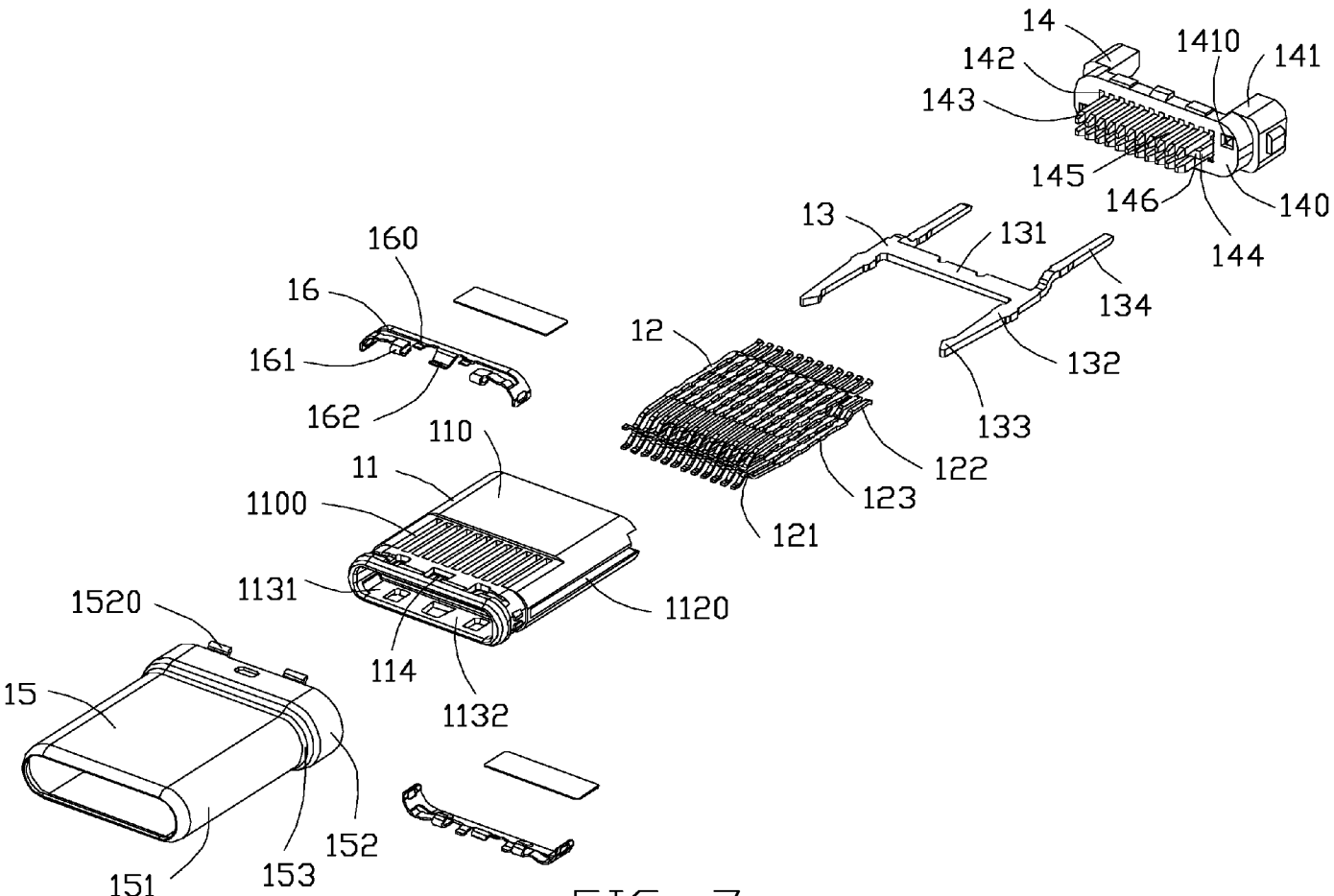
FIG. 7 is an exploded view of partly members of the cable connector assembly as shown in FIG. 5.
Figure 8:
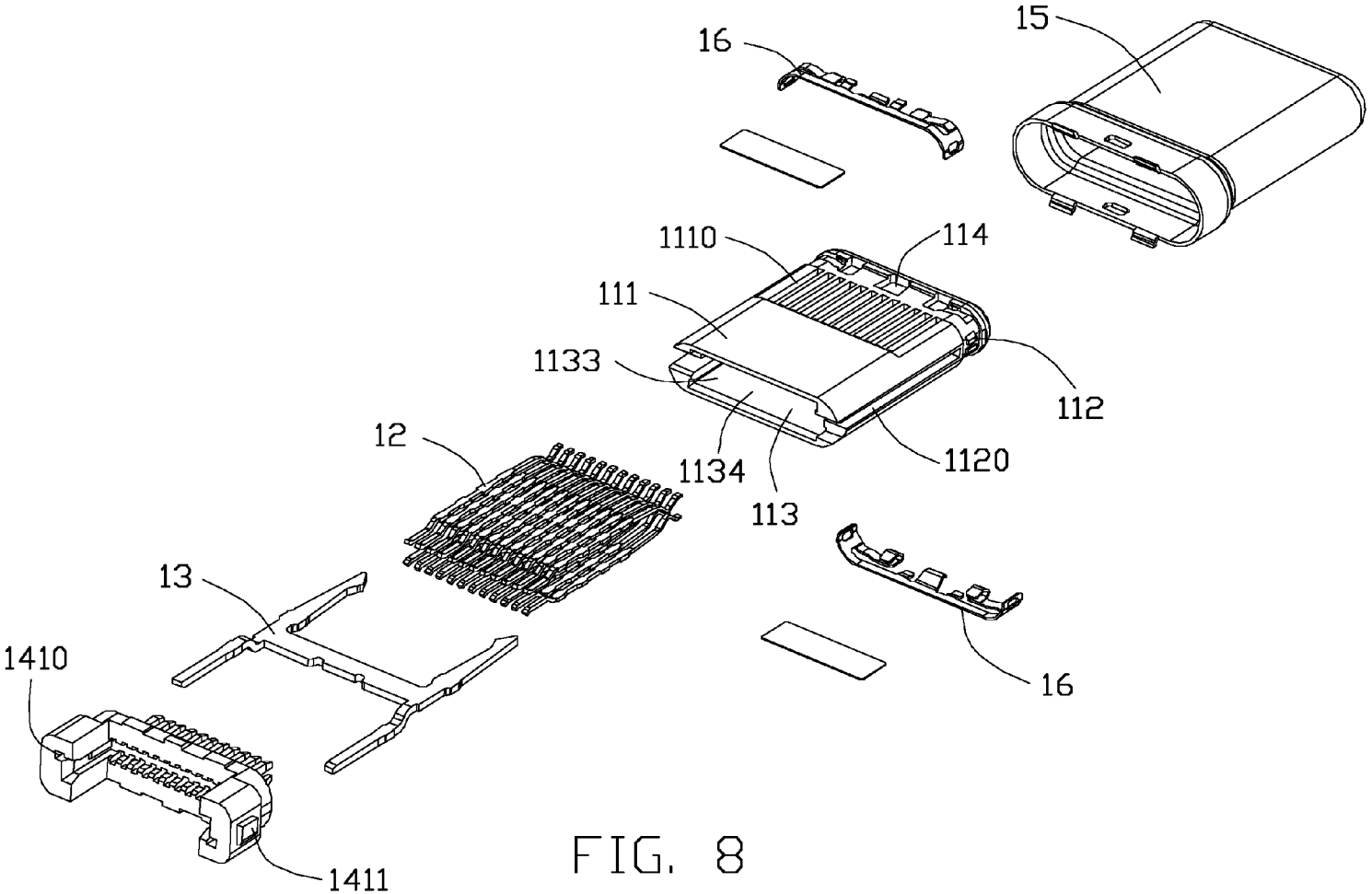
FIG. 8 is an exploded view of partly members of the cable connector assembly as shown in FIG. 7 but from a different perspective.

Referring to FIG. 7 and FIG. 8, the plug portion 1 includes an insulative housing 11, a plurality of conductive terminals 12 received in the insulative housing 11 and arranged in two rows spaced apart from each other in a vertical direction, a latch 13 disposed between the two rows of conductive terminals 12 for latching with the mating connector, an insulative member 14 disposed behind the insulative housing 11, a mating shell 15 disposed outside of the insulative housing 11 and the insulative member 14, and a pair of grounding members 16 disposed on the insulative housing 11 and electrically connected to the metal shell 15.

The insulative housing 11 includes a top wall 110, a bottom wall 111 spaced apart from and parallel with the top wall 110, a pair of side walls 112 connecting the top wall 110 and the bottom wall 111, and a receiving space 113 surround by the top, bottom, and side walls. The receiving space 113 is divided into a front portion 1132 having a front opening 1131, and a rear portion 1134 having a rear opening 1133. The top wall 110 defines a top slot 1100 in communication with the front portion 1132. The bottom wall 111 defines a bottom slot 1110 in communication with the front portion 1132. Each of the side walls 112 defines a side slot 1120 extending forwardly from a rear end of the insulative housing 11 but not through a front end of the insulative housing 11. The side slots 1120 are in communication with the front portion 1132 and the rear portion 1134 of the receiving room 113. There are a plurality of recess 114 defined in front of the top wall 110 and the bottom wall 111 of the insulative housing 11.

Each of the terminals 12 defines a front mating portion 121 extending forwardly into the front portion 1132 of the receiving room 113, a rear mating portion 122 extending rearwardly, and an intermediate retaining portion 123 secured to the insulative housing 11. The front mating portion 121 is to be mated with the mating connector and the rear mating portion 122 is to be mated with the PCB 2. The front mating portions 121 of the two rows of terminals 12 are arranged face to face along the vertical direction.

The latch 13 includes a base portion 131 extending along a transverse direction, a pair of latch beams 132 respectively extending forwardly from two opposite ends of the base portion 131, a pair of latch portions 133 extending from front end of the latch beams 132 along a face to face direction and a pair of extending beams 134 respectively extending rearwardly from two opposite ends of the base portion 131. One of the extending beam 134 is located above the plane of the base portion 131 and the other is located below the plane of the base portion 131. The latch 13 is mounted into the insulative housing 11 through the rear opening 1133 of the rear portion 1134 of the receiving space 113. The latch beams 132 are received into the side slots 1120, respectively. At least a portion of each of the latch portions 133 projects into the front portion 1132 of the receiving space 113. The pair of latch portions are arranged face to face along the transverse direction.

The insulative member 14 cooperates with the insulative housing 11 to fix the latch 13. The insulative member 14 includes an insulative base portion 140, a pair of extending portions 141 extending rearwardly from two opposite ends of the insulative base portion 140, two rows of through holes 142 spaced apart in the vertical direction and extending through the insulative base portion 140 along a front to rear direction, two rows of posts 143 spaced apart in the vertical direction and extending forwardly from the insulative base portion 140, and a projected portion 144 extending forwardly between the two rows of posts 143. A channel 145 is formed between every two adjacent posts 143 of each row and is in communication with a corresponding one of the through holes 142. Each of the extending portions 141 defines a mounting slot 1410 extending along a rear to front direction. The posts 143 extend forwardly beyond the projected portion 144. A receiving slot 146 is formed between the two rows of posts 143. The insulative base portion 140 is thicker than the insulative housing 11. The insulative base portion 140 extends outwardly respect to the top wall 110 and the bottom wall 111 after the insulative member 14 being mounted to the insulative housing 11 along a rear to front direction. The base portion 131 of the latch 13 is received into the receiving slot 146 of the insulative member 14, the projected portion 144 is pressed against a rear side of the base portion 131, and the pair of extending beams 134 are extending into the corresponding mounting slots 1410. The rear mating portions 122 of the terminals 12 extend through the insulative member 140 by passing the channels 145 and the through holes 142, respectively. Each of the extending beams 134 defines a projection 1411.

The mating shell 15 has a closed circumference that has a good seal performance, a good anti-EMI performance, etc. The closed circumference of the mating shell 15 could be manufactured by drawing a metal piece, bending a metal piece, die casting, etc. The mating shell 15 includes a first front end 151 for being inserted into the mating connector, a first rear end 152, and a first transition portion 153 for connecting the first front end 151 and the first rear end 152. A diametrical dimension of the first front end 151 is smaller than the diametrical dimension of the first rear end 152. The first rear end 152 defines a plurality of latch tabs 1520 projecting outwardly.

One of the grounding members 16 is received on the top slot 1110, and the other one is received on the bottom slot 1110. Each of the grounding members 16 includes a grounding body portion 160, a pair of grounding tabs 161 extending from two opposite ends of the grounding body portion 160 and toward the insulative housing 11, and a contacting tab 162 extending forwardly from a front side of the grounding body portion 160 and entering into the front portion 1132 of the receiving space 113. The grounding tabs 161 and the contacting tab 162 are receiving into the recesses 114 of the insulative housing 11, and the contacting tab 162 is used for mating with the mating connector. The contacting tabs 162 of the pair grounding members 16 are disposed face to face along the vertical direction. A distance along the vertical direction between the contacting tabs 162 of the pair of grounding members 16 is greater than a distance along the vertical direction of the front mating portions 121 of the two rows of terminals 12.

Figure 5:
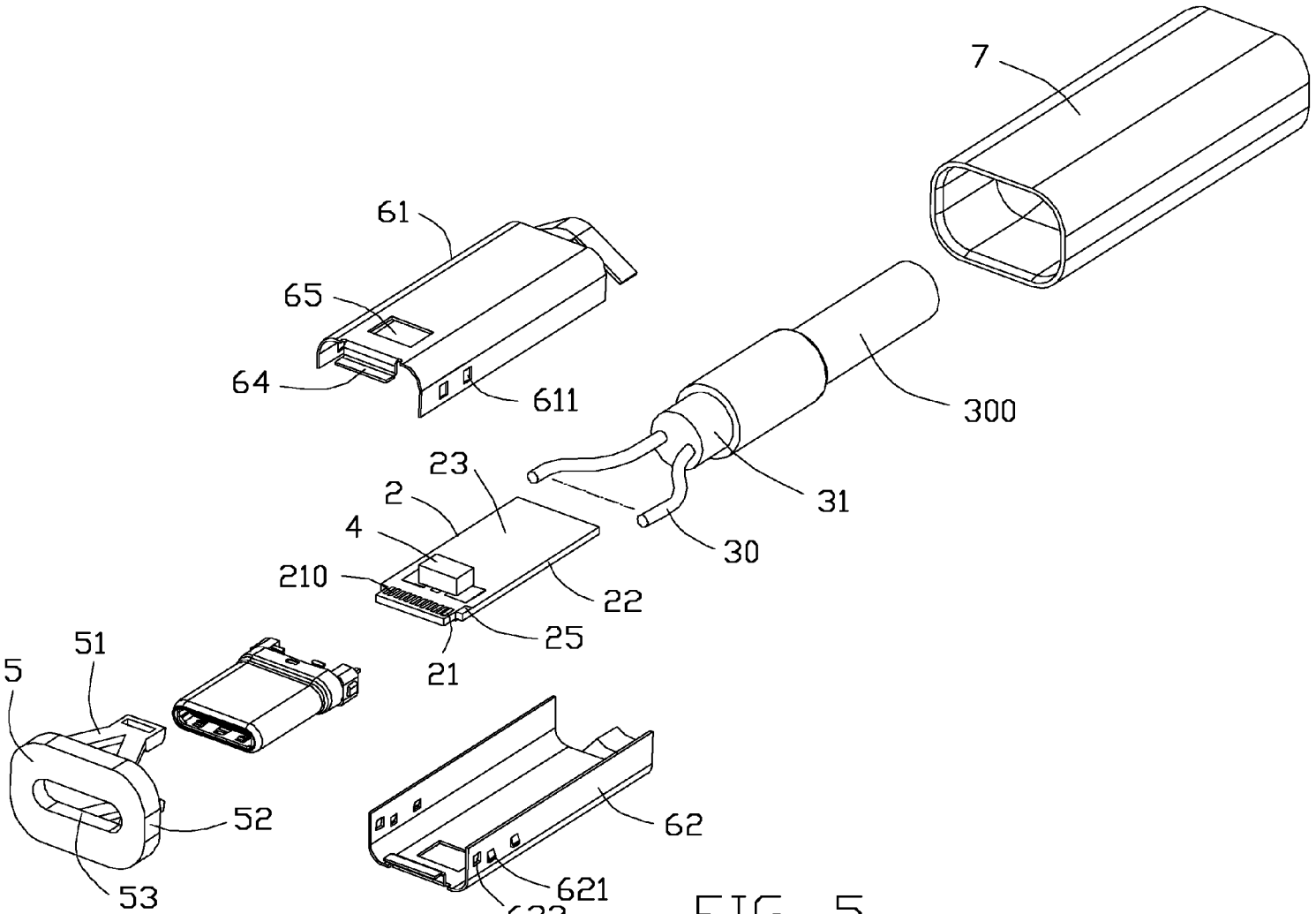
FIG. 5 is an exploded perspective view of the cable connector assembly as shown in FIG. 1.

Referring to FIG. 5 and FIG. 6, the PCB 2 is disposed between the plug portion 1 and the cable 300. The cable 300 is electrically connected with the terminals 12 by the PCB 2. The PCB 2 includes a front end portion 21, a rear end portion 22, an upper surface 23 and an opposite lower surface 24. The upper and the lower surface of the front end portion 21 define a plurality of front conductive pads 210 connected with the rear mating portion 122 of the terminals 12, while the lower surface of the rear end portion 22 define a pair of rear conductive pads 220 connected to the cable 300. The dimension of the front end portion 21 of PCB 2 is smaller than the dimension of the rear end portion 22 of PCB 2, the dimension of the rear conductive pad 220 is larger than the dimension of the front conductive pad 210. Each of the upper surface 23 and the lower surface 24 defines a metal bar 25 used for the corresponding extending beam 134 of the latch 13 being soldered in order to strengthen fixing of the latch 13. The front end portion 21 is disposed between the rear mating portions 122 of the upper and lower terminals 12, and the rear mating portions 122 are electrically connected to the corresponding front conductive pads 210.

Referring to FIG. 5, the cable 300 includes a plurality of core wires 30 and an insulative layer 31 covering the core wires 30.

The LED lamps 4 are symmetrically arranged on the upper surface 23 and lower surface 24 of the PCB 2, and the LED lamps 4 emit light perpendicular to the PCB 2.

Figure 9:
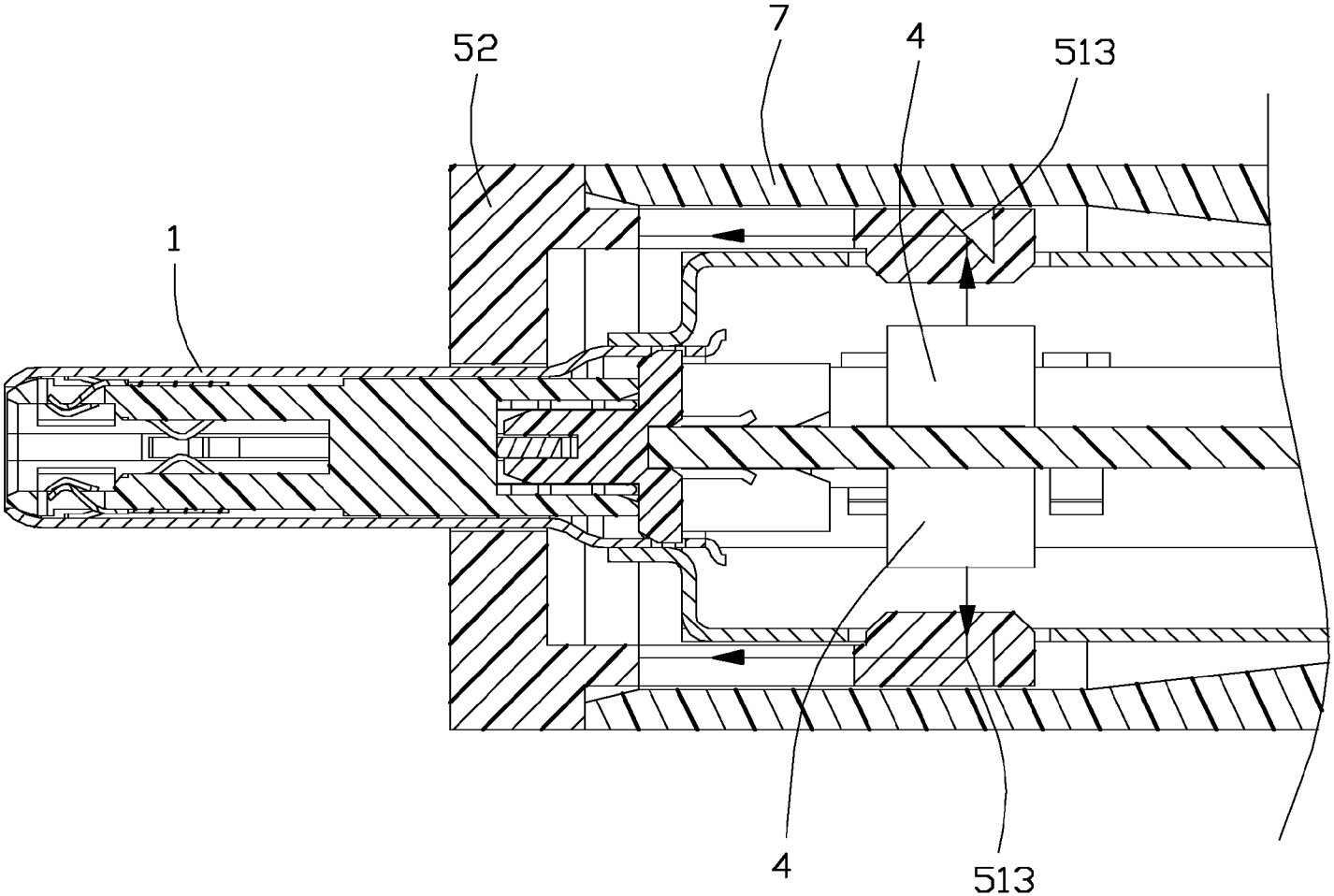
FIG. 9 is a cross-sectional perspective view of the cable connector assembly take along the line 9-9 as shown in FIG. 1.

The optical element 5 includes a pair of transition portions 51 transmitting the light emitted by the LED lamps 4 and a photic zone 52 used for the user to observe the working status of the cable connector assembly 100. The photic zone 52 of the optical element 5 is exposed to the insulative shell 7 and has a closed circumference so that the light emitted by the LED lamps 4 passes through the photic zone 52 to form a continuous aperture. The pair of transition portions 51 of the optical element 5 are disposed symmetrically in a vertical direction and each defines a reflecting portion 511 disposed opposite to the LED lamp 4 and changing the transmission direction of the light and a pair of transmission channels 512 extending obliquely to both sides thereof from the reflecting portion 511 in the same plane of the reflecting portion 511. The transmission channel 512 is used for making the reflecting portion 511 connected to the a horizontal plane of the photic zone 52, and a triangular structure is formed between the transmission channels 512 and the photic zone 52 to facilitate the vertical surface of photic zone 52 can be brought together more light so that light diverged by the four surfaces of the photic zone 52 is more uniform. Referring to FIG. 9, the light emitted by the LED lamp 4 is perpendicular to the PCB 2, the reflecting portion 511 defines a 45° inclined surface 513 recessed from the outer surface thereof so that the light emitted by the LED lamp 4 enters the reflecting portion 511 vertically, then the light exits along a direction parallel to the PCB 2 after the light reflected by the inclined surface 513. The photic zone 52 of the optical element 5 defines a through hole 53 for the first front end 151 of the mating shell 115 through, and the through hole 53 is abutting against the first transition portion 153 of the mating shell 15 when the optical element 5 is mounted on the mating shell 5 in the front to rear direction.

Figure 3:
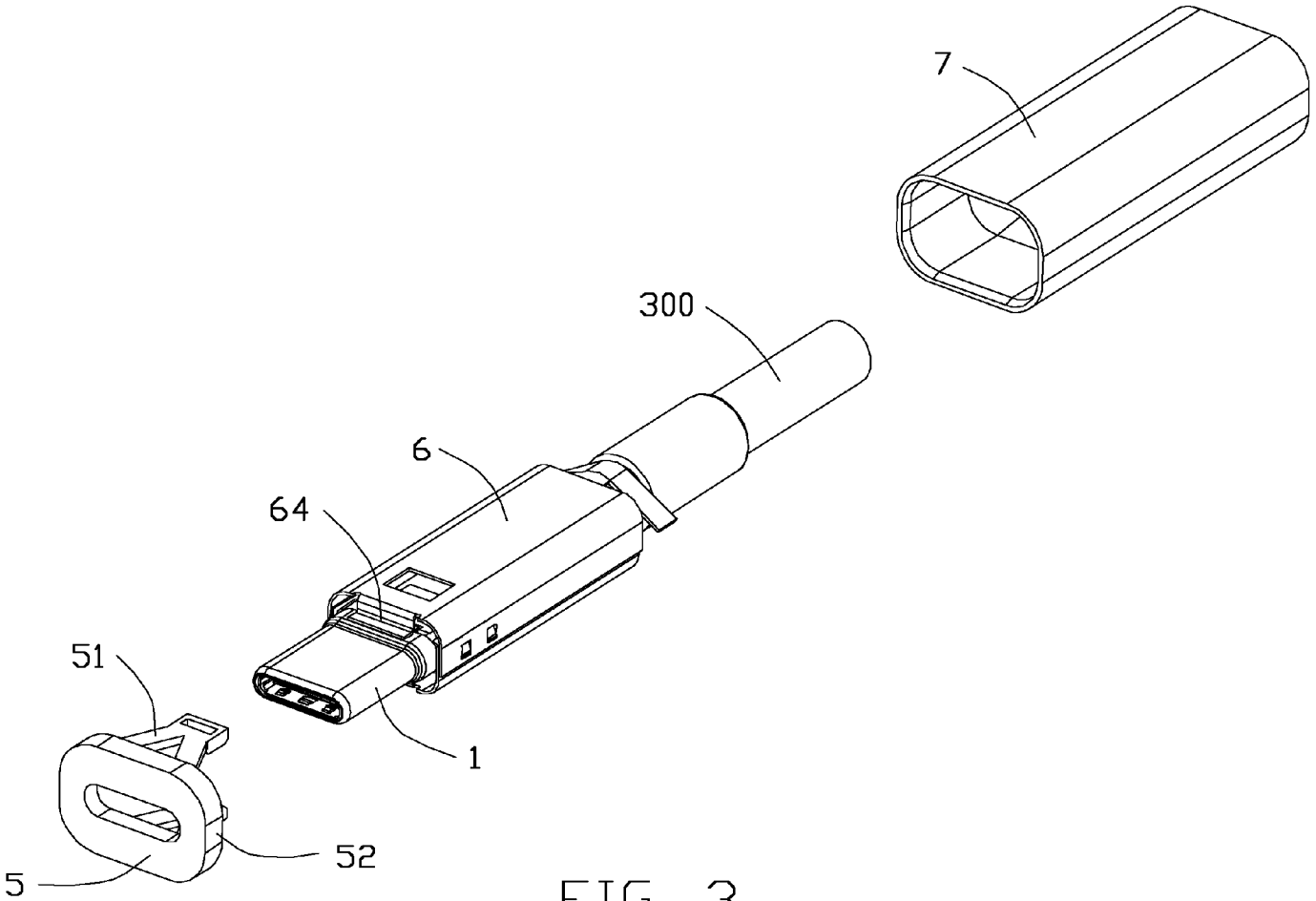
FIG. 3 is another partially exploded view of the cable connector assembly as shown in FIG. 1.
Figure 4:
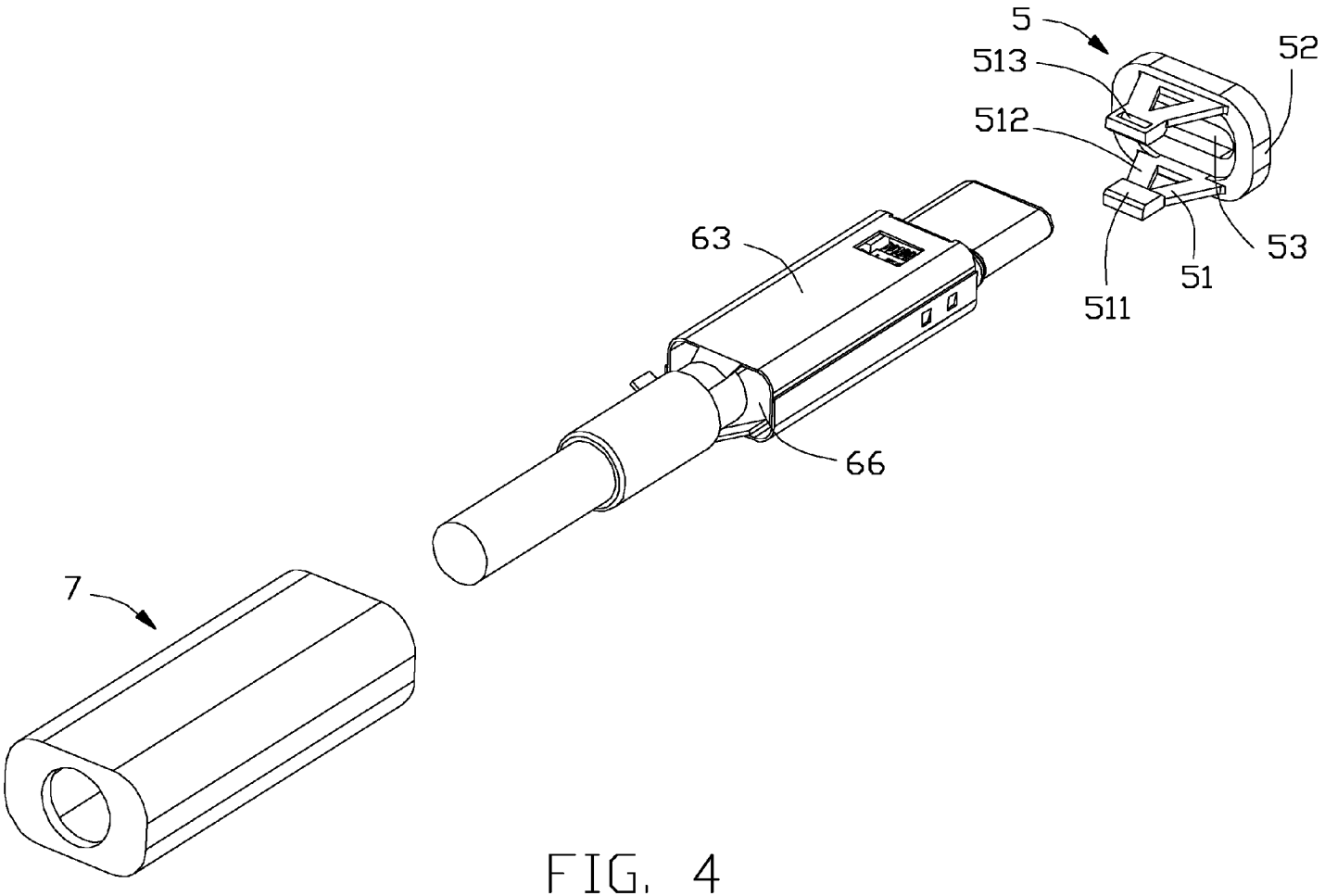
FIG. 4 is a partially exploded view of the cable connector assembly as shown in FIG. 3 but from a different perspective.

Referring particularly to FIG. 3 and FIG. 4, the metal shell 6 includes a first shell 61 and a second shell 62 mating with each other, each of the first shell 61 and the second shell 62 defines a main portion 63, a tongue portion 64 extending forwardly from the main portion 63 and an opening 65. In this embodiment, the tongue portion 64 is fixed to the first rear end 152 by soldering, in other embodiments, the tongue portion 64 can be fixed to the first rear end 152 by gluing or other manners. The opening 62 makes the LED lamp 4 facing to the corresponding the reflecting portion 511 of the optical element 5. The first shell 61 defines a plurality of latch holes 611 disposed on both sides thereof and the second shell 62 defines a plurality of latch tabs 621 disposed on both sides thereof, the first shell 61 is fixed to the second shell 62 by the latch tabs 621 being retained in the corresponding latch holes 611. The second shell 62 further defines a pair of retaining holes 622 used for receiving the projections 1411 of the insulative member 14. The first shell 61 and the second shell 62 of the metal shell 6 together form an receiving cavity 66, the height of the receiving cavity 66 is larger than the overall height of the PCB 2 with two LED lamps 4.

The assembling process of the cable connector assembly 100 is as follows, firstly the LED lamps 4 are mounted on the upper surface 23 and the lower surface 24 of the PCB 2, the PCB 2 is inserted into the plug portion 1, and the extending beams 134 of the latch 13 are soldered on the metal bars 25 of the PCB 2. Then the core wires 30 of the cable 300 are soldered and fixed on the rear end portion 22 of the PCB 2.

The metal shell 6 is assembled to the PCB 2 in the vertical direction, the first shell 61 is fixed to the second shell 62 by the latch tabs 621 being retained in the corresponding latch holes 611. The second shell 62 further defines a pair of retaining holes 622 used for receiving the projections 1411 of the insulative member 14, and the tongue portion 64 is fixed to the first rear end 152 of the mating shell 15 by soldering. The optical element 5 is mounted on the mating shell 5 in the front to rear direction until the through hole 53 abuts against the first transition portion 153 of the mating shell 15, while the reflecting portion 511 is facing to the opening 65.

The insulative shell 7 is assembled to the outside of the metal shell 6 and the photic zone 52 of the optical element 5 is exposed to the insulative shell 7 so that the insulative shell 7 can be fixed to the optical element 5 and metal shell 6 by gluing or other manners. Thus, the assembly of the cable connector assembly 100 is completed. However, the assembly sequence of the cable connector assembly 100 is not unique, the maker can make adaptations as needed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A cable connector assembly, comprising:

an electrical connector defining a plug portion, a printed circuit board electrically connected to the plug portion, a pair of LED (Laser Emitting Diode) lamps mounted on the printed circuit board, an optical element transmitting the light emitted by the LED lamps and an insulative housing covering the printed circuit board; and a cable electrically connected with the electrical connector; wherein the optical element defines a pair of transition portions transmitting the light emitted by the LED lamps and a photic zone, the photic zone of the optical element is exposed to the insulative shell and has a closed circumference so that the light emitted by the LED lamps passes through the photic zone to form a continuous aperture; wherein the light emitted by the LED lamp is perpendicular to the primed circuit board, the reflecting portion defines a 45° inclined surface recessed from the outer surface thereof so that the light emitted by the LED lamp enters the reflecting portion vertically, then the light exits along a direction parallel to the primed circuit board after the light reflected by the inclined surface.

2. The cable connector assembly as described in claim 1, wherein the plug portion includes a mating shell, the mating shell defines a first front end for being inserted into the mating connector, a first rear end, and a first transition portion for connecting the first front end and the first rear end, the photic zone of the optical element defines a through hole used for the first front end of the mating shell through, and the through hole is abutting against the first transition portion of the mating shell when the optical element is mounted on the mating shell in the front to rear direction.

3. The cable connector assembly as described in claim 1, wherein each transition portion defines a reflecting portion disposed opposite to the LED lamp and changing the transmission direction of the light and a pair of transmission channels extending obliquely to both sides thereof from the reflecting portion in the same plane of the reflecting portion, the transmission channel is used for making the reflecting portion connected to the a horizontal plane of the photic zone.

4. The cable connector assembly as described in claim 3, wherein the printed circuit board defines an upper surface and a lower surface opposite to each other, and the LED lamps are symmetrically arranged on the upper surface and lower surface of the printed circuit board.

5. The cable connector assembly as described in claim 4, wherein the pair of transition portions are symmetrically arranged and corresponding to the LED lamps.

6. The cable connector assembly as described in claim 3, wherein the cable connector assembly further defines a metal shell, and the metal shell defines an opening used for the reflecting portion facing to.

7. The cable connector assembly as described in claim 6, wherein the metal shell defines a receiving cavity, and the height of the receiving cavity is larger than the overall height of the printed circuit board with two LED lamps.

8. A cable connector assembly used for engaging with a mating connector, comprising:

an electrical connector defining a plug portion, a primed circuit board electrically connected to the plug portion, a pair of LED (Laser Emitting Diode) lamps mounted on the printed circuit board, an optical element transmitting the light emitted by the LED lamps and an insulative housing covering the primed circuit board; and a cable electrically connected with the electrical connector; wherein the optical element defines a pair of transition portions transmitting the light emitted by the LED lamps and a photic zone exposed to the insulative shell, each transition portion defines an inclined surface recessed ~on the outer surface thereof so that the light emitted by the LED lamp enters the reflecting portion in a vertical direction, then the light exits along a horizontal direction perpendicular to the vertical direction after the light reflected by the inclined surface, and the light emitted by the LED lamps passes through the photic zone to form a continuous aperture; wherein each transition portion defines a reflecting portion disposed opposite to the LED lamp and changing the transmission direction of the light and a pair of transmission channels extending obliquely to both sides thereof ~om the reflecting portion in the same plane of the reflecting portion, the inclined surface is disposed in the reflecting portion and the transmission channel is used for making the reflecting portion connected to the a horizontal plane of the photic zone.

9. The cable connector assembly as described in claim 8, wherein the photic zone of optical element has a closed circumference and defines a through hole used for the plug portion through.

10. The cable connector assembly as described in claim 8, wherein the LED lamps are symmetrically arranged on the upper surface and lower surface of the printed circuit board, and the transition portions are symmetrically arranged corresponding to the LED lamps.

11. A cable connector assembly comprising:

a plug portion including an insulative housing enclosed within a metallic mating shell and enclosing a plurality of contacts, said plug portion forwardly communicating with an exterior in a front-to-back direction;

a printed circuit board located (PCB) behind the plug portion and electrically and mechanically connected to the contacts around a front region of the PCB;

a cable including a plurality of wires mechanically and electrically connected to rear region of PCB;

at least an LED (Laser Emitting Diode) lamp mounted upon the PCB;

an optical element function as a waveguide and including unitarily a front photic zone and a rear transition portion; wherein the front photic zone is located around a rear region of the plug portion and forwardly and radially exposed to said exterior, and the rear transition portion is intimately positioned around the LED lamp in a vertical direction perpendicular to said front-to-back direction and to said PCB.

12. The cable connector assembly as claimed in claim 11, wherein the front photic zone forms a frame structure through which the plug portion extends forwardly.

13. The cable connector assembly as claimed in claim 11, wherein there are two LED lamps are located upon two opposite surfaces of the PCB, and the rear transition portion has two parts located by two opposite surfaces of the PCB to confront the corresponding LED lamps in the vertical direction.

14. The cable connector assembly as claimed in claim 11, wherein said rear transition portion includes a reflecting surface to direct light from the LED lamp toward the front photic zone.

15. The cable connector assembly as claimed in claim 11, further including a metallic shell enclosing the PCB and forming an opening through which the rear transition portion extends.

16. The cable connector assembly as claimed in claim 15, further including an insulative cover enclosing the metallic shell while the front photic zone is located in front of said insulative cover.

17. The cable connector assembly as claimed in claim 15, wherein said metallic shell grasps the cable for securing.

18. The cable connector assembly as claimed in claim 17, wherein said insulative cover shield the rear transition portion in the vertical direction.

* * * * *